US009896887B2

(12) United States Patent
Sorokan et al.

(10) Patent No.: US 9,896,887 B2
(45) Date of Patent: Feb. 20, 2018

(54) DRILLING RIG WITH HINGED, RETRACTABLE OUTRIGGERS

(71) Applicant: National Oilwell Varco, L.P., Houston, TX (US)

(72) Inventors: Ron Sorokan, Sherwood Park (CA); Kameron Wayne Konduc, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 503 days.

(21) Appl. No.: 14/610,114

(22) Filed: Jan. 30, 2015

(65) Prior Publication Data

US 2015/0152690 A1 Jun. 4, 2015

Related U.S. Application Data

(63) Continuation of application No. 13/264,033, filed as application No. PCT/US2010/044646 on Aug. 6, 2010, now Pat. No. 8,985,238.

(60) Provisional application No. 61/232,075, filed on Aug. 7, 2009.

(51) Int. Cl.

| | |
|---|---|
| ***E21B 7/02*** | (2006.01) |
| ***E21B 15/00*** | (2006.01) |
| ***E21B 19/15*** | (2006.01) |

(52) U.S. Cl.

CPC ..... *E21B 15/003* (2013.01); *E21B 7/02* (2013.01); *E21B 19/155* (2013.01); *E21B 7/023* (2013.01); *E21B 15/00* (2013.01); *Y10T 29/49716* (2015.01)

(58) Field of Classification Search

CPC ..... E21B 15/003; E21B 7/02; E21B 19/155; E21B 7/023; E21B 15/00

USPC ..... 173/26, 28, 184–187

See application file for complete search history.

(56) References Cited

U.S. PATENT DOCUMENTS

| | | | | |
|---|---|---|---|---|
| 4,290,495 | A | 9/1981 | Elliston | |
| 4,899,832 | A | 2/1990 | Bierscheid | |
| 6,546,312 | B1 | 4/2003 | Matsumoto | |
| 7,748,471 | B2 * | 7/2010 | Osadchuk | E21B 7/02 173/28 |
| 2002/0003119 | A1 | 1/2002 | Rode | |
| 2004/0211598 | A1 * | 10/2004 | Palidis | E21B 15/00 175/162 |
| 2007/0215359 | A1 | 9/2007 | Wood | |

OTHER PUBLICATIONS

European Official Action 94(3) dated Nov. 18, 2016, for European Patent Application No. 10742979.7, filed on Mar. 7, 2012 (PCT Effective—Aug. 6, 2010).

PCT Search Report and Written Opinion from PCT/US2010/044646 dated Jul. 5, 2011.

* cited by examiner

*Primary Examiner* — Michelle Lopez

(74) *Attorney, Agent, or Firm* — Amerson Law Firm, PLLC

(57) ABSTRACT

A method includes coupling a plurality of outriggers to a drill rig structure, supporting the weight of the drill rig structure with the plurality of outriggers, and moving the drill rig structure while supporting the weight with the plurality of outriggers.

19 Claims, 7 Drawing Sheets

DRILLING RIG WITH HINGED, RETRACTABLE OUTRIGGERS

CROSS-REFERENCE TO RELATED APPLICATIONS

This is a continuation of U.S. patent application Ser. No. 13/264,033, filed Dec. 27, 2011, which was a 371 of PCT/US10/44646, filed Aug. 6, 2010, which claimed priority from U.S. provisional patent application Ser. No. 61/232,075, filed Aug. 7, 2009.

BACKGROUND OF THE INVENTION

Field of the Invention

The present invention is drawn to oilfield drilling structures which may be easily moved from one drilling position to another by use of outboard, hinged outriggers. These structures are useful in drilling oil wells in fields where a great many boreholes are required to sustain the production of oil. The invention further provides a drill rig having features which allow it to be transported along roadways from one oilfield drilling location to another.

Description of the Related Art

There are numerous patents and publication regarding 'mobile' oil well drilling rigs that may be transported in a 'stowed' mode along public highways and which may also be moved in an 'erected' mode when drilling multiple adjacent wells within a particular oil field. One such patent, U.S. Pat. No. 3,754,361, incorporated by reference herein for all it discloses, discussed a wheeled structure to transport a drilling rig with rotatable wheel assemblies which allow the rig to be moved by using a 'fifth wheel' arrangement which may be rotated to any angle. These wheels are permanently attached, however, which may consume considerable space and add unnecessary weight.

U.S. Pat. No. 4,375,892 discloses a more flexible 'dolly type' structure which also allows a rig to be moved in any desired direction. However, this structure shares many of the same general problems as U.S. Pat. No. 3,754,361, as described above.

Furthermore, U.S. Pat. Nos. 4,305,237; 4,290,495; 3,807,109; 4,823,953; 4,823,870 and US Publication number 2007/0215359 all show various arrangements for movable drill rigs.

BRIEF SUMMARY OF THE INVENTION

Disclosed herein is a mobile drilling structure with a base frame adapted to accommodate one or more tractor units or wheeled frame dollies to drill a series of relatively closely spaced boreholes in an oil field. The drilling structure has a plurality of hinged outriggers adapted to transfer the weight of the drilling structure to a plurality of outboard wheeled frame dollies, but which may be retracted when not needed. The hinged outriggers allow the drilling structure to be more easily moved when lateral and longitudinal movements of the drilling structure are required in a confined area.

Having the outriggers retractable allows more flexibility in using the wheeled frame dollies to move the rig along what is often a maze of piping and well heads in an oilfield. For example, the rigs may be easily moved along an existing row in a grid of already drilled boreholes, and without turning the rig, the wheeled frame dollies may be repositioned to allow the rig to be moved along the row of wells perpendicular to the one just traversed by the rig, without having to rotate the drill rig. Furthermore the removable wheeled frame dollies allow the drilling structures to be transported more easily along public highways, because that may allow a 'narrower' rig profile.

The present disclosure is generally directed to various apparatuses and methods for moving drill rig structures between adjacent wellbore sites. In one illustrative embodiment, a method is disclosed that includes, among other things, coupling a plurality of outriggers to a drill rig structure, supporting the weight of the drill rig structure with the plurality of outriggers, and moving the drill rig structure while supporting the weight with the plurality of outriggers.

In another exemplary embodiment, a method includes pivotably coupling at least one outrigger to a drill rig structure, pivotably rotating the at least one outrigger to a substantially horizontal extended support position, supporting at least a portion of the weight of the drill rig structure with the at least one outrigger while the at least one outrigger is in the substantially horizontal extended support position. The disclosed method also includes, among other things, moving the drill rig structure while the at least one outrigger is in the substantially horizontal extended support position and is supporting at least said portion of the weight of the drill rig structure.

A further illustrative method disclosed herein includes coupling a plurality of hinged outriggers to a drill rig structure, transferring the weight of the drill rig structure to a plurality of wheeled rig movement apparatuses with the plurality of hinged outriggers, and moving the drill rig structure with the plurality of wheeled rig movement apparatuses from a first wellbore location of an oilfield drilling site to a second wellbore location of the oilfield drilling site that is adjacent to the first wellbore location while the weight of the drill rig structure is transferred to the plurality of wheeled rig movement apparatuses with the plurality of hinged outriggers.

DETAILED DESCRIPTION OF THE INVENTION

Figure 1:
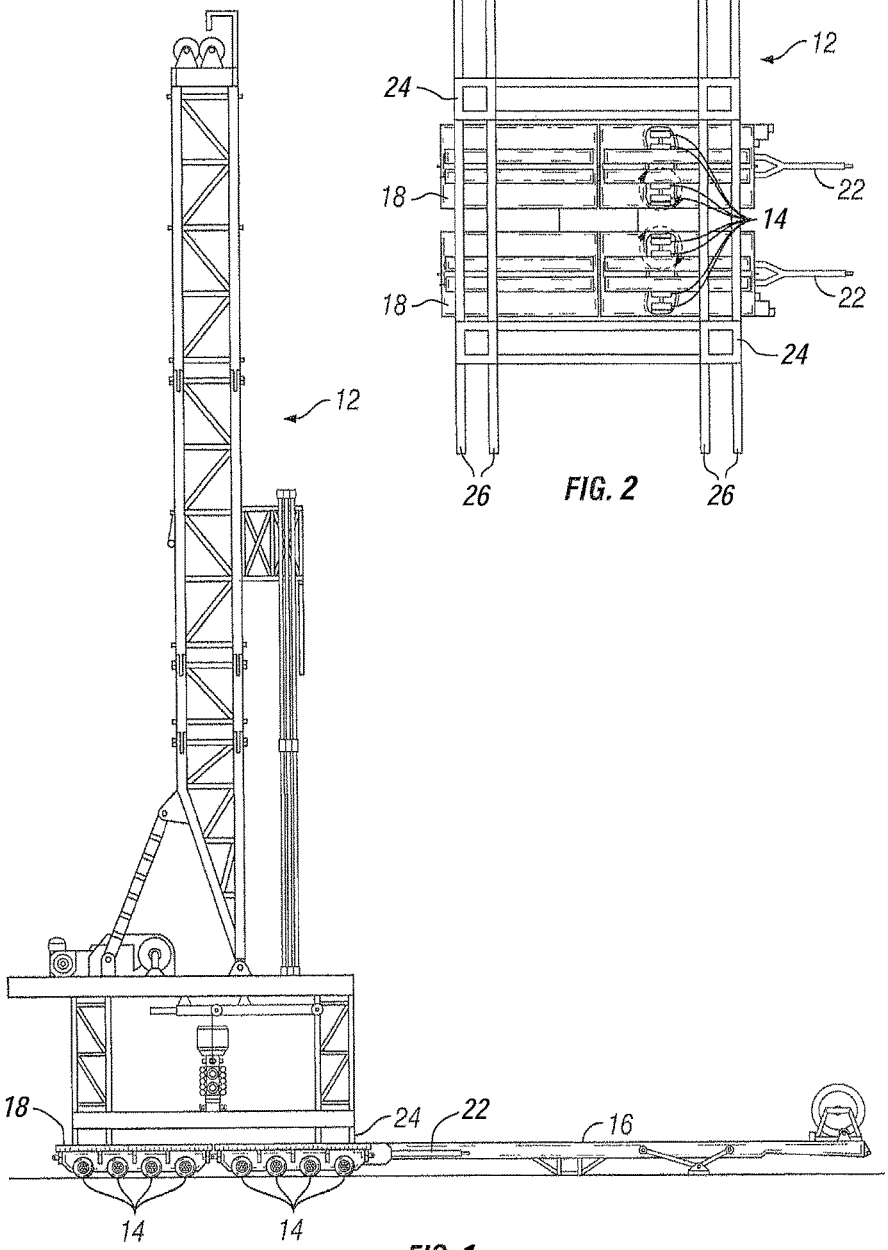
FIG. 1 is a side elevation view of a drill rig of the present invention.
Figure 3:
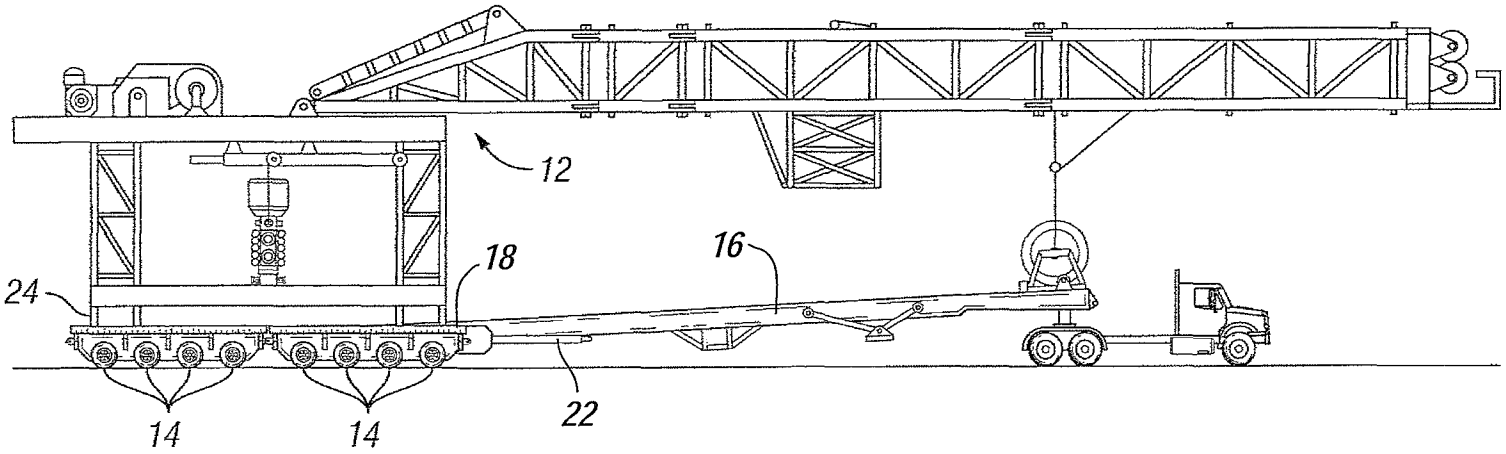
FIG. 3 is a side elevation view of the drill rig of FIG. 1 arranged for transport along a public highway.

Turning now to FIG. 1, the drill rig 12 of the present invention is a transportable type of drilling rig which allows it not only to be moved short distances such as the several hundred feet from one wellbore to be drilled to the next as illustrated in the configuration shown in FIG. 1, but which also may be disassembled, packaged and towed (as shown in FIG. 3) over public highways from one location to another which may be hundreds of miles apart.

Figure 2:
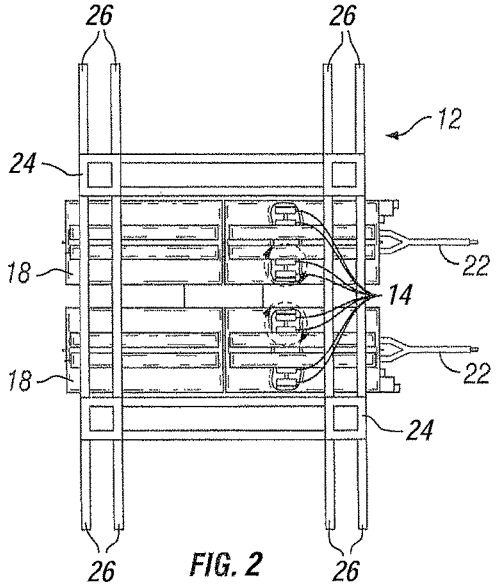
FIG. 2 is a cut-top view of wheeled frame dollies arranged to lie within the support columns of the drill rig of FIG. 1.

Since a fully assembled drill rig 12 may weigh several hundred tons, moving it for even very short distance may be challenging. The drill rig 12 of the present invention may be placed upon one or more wheeled frame dollies 18, which are fitted with a number of wheels 14 (as shown in FIG. 1) and may be pulled along by a single towing bar 16. In some cases the wheeled dollies 18 with rotatable wheels 14 are towed to the next well site by each of their individual tow bars 22, as shown in FIG. 2.

Alternately, (and preferably) these dollies 18 may have motors built into their wheels 14 which allow them to be self propelled. In this case, each of the wheels 14 of the wheeled dollies 18 may be independently powered and individually and independently turned to the left or right to steer the drill rig 12 as it is being moved. In addition, the dollies 18 may have built-in jacking devices which allow them to be placed under the substructures 24 and elevated to contact and lift the drill rig 12. The drill rig 12 of the present invention as shown in FIGS. 1-10 is adapted to be carried upon these wheeled frame dollies 18.

Figure 4:
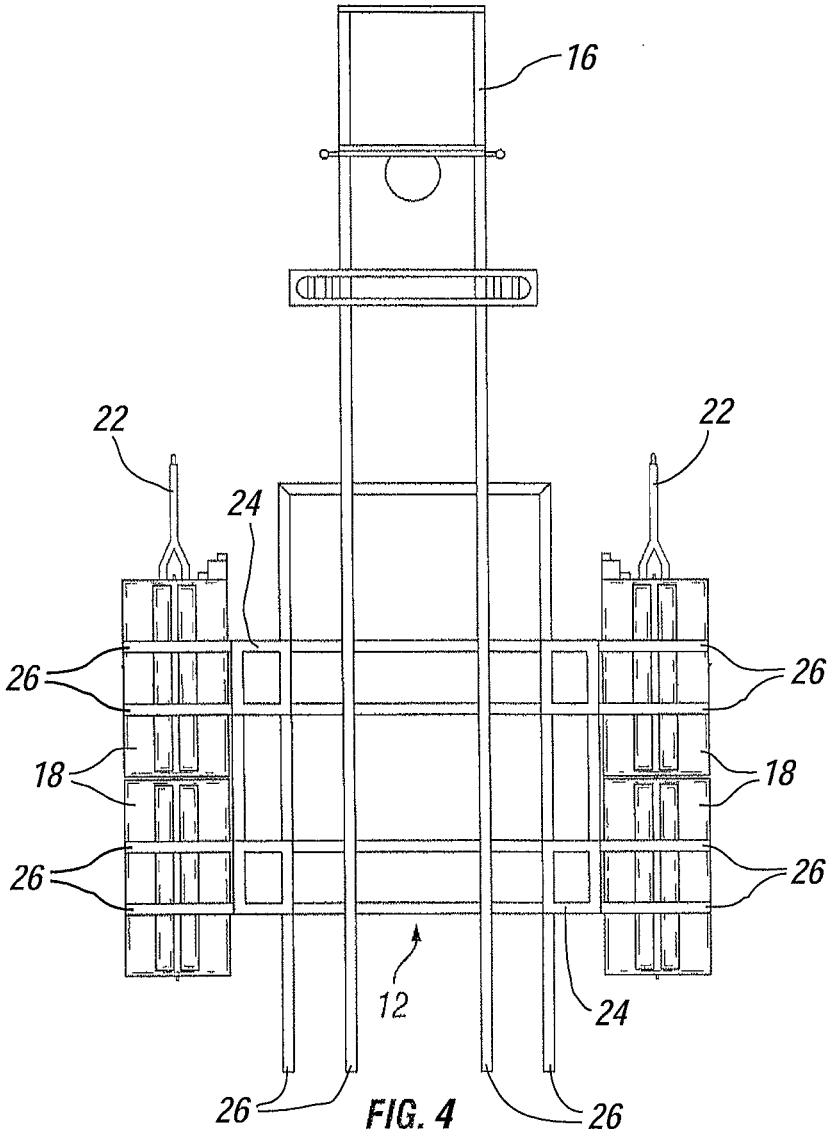
FIG. 4 is a top view of a cutaway portion of a structure similar to FIG. 1, to show wheeled frame dollies mounted outboard of the rig structure and carried on the hingable outriggers of the present invention.
Figure 5:
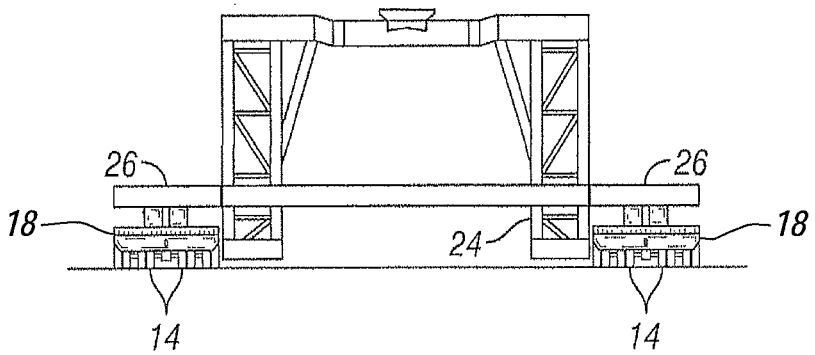
FIG. 5 is an end elevation view of the structure and hinged outriggers of FIG. 4.
Figure 6:
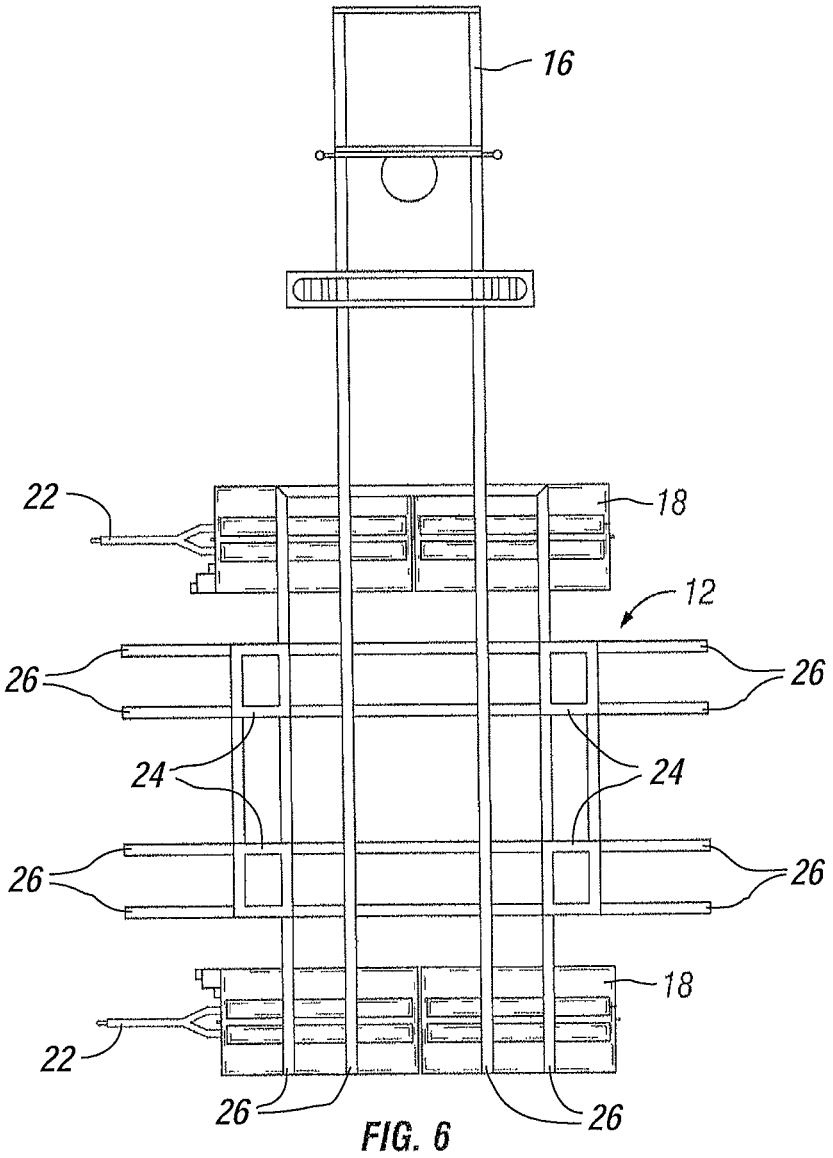
FIG. 6 is a top view of a cutaway portion of a structure similar to FIG. 1, to show wheeled frame dollies adapted to move the rig transversely, supported by the rig structure itself and with retracted hingable outriggers of the present invention.
Figure 7A:
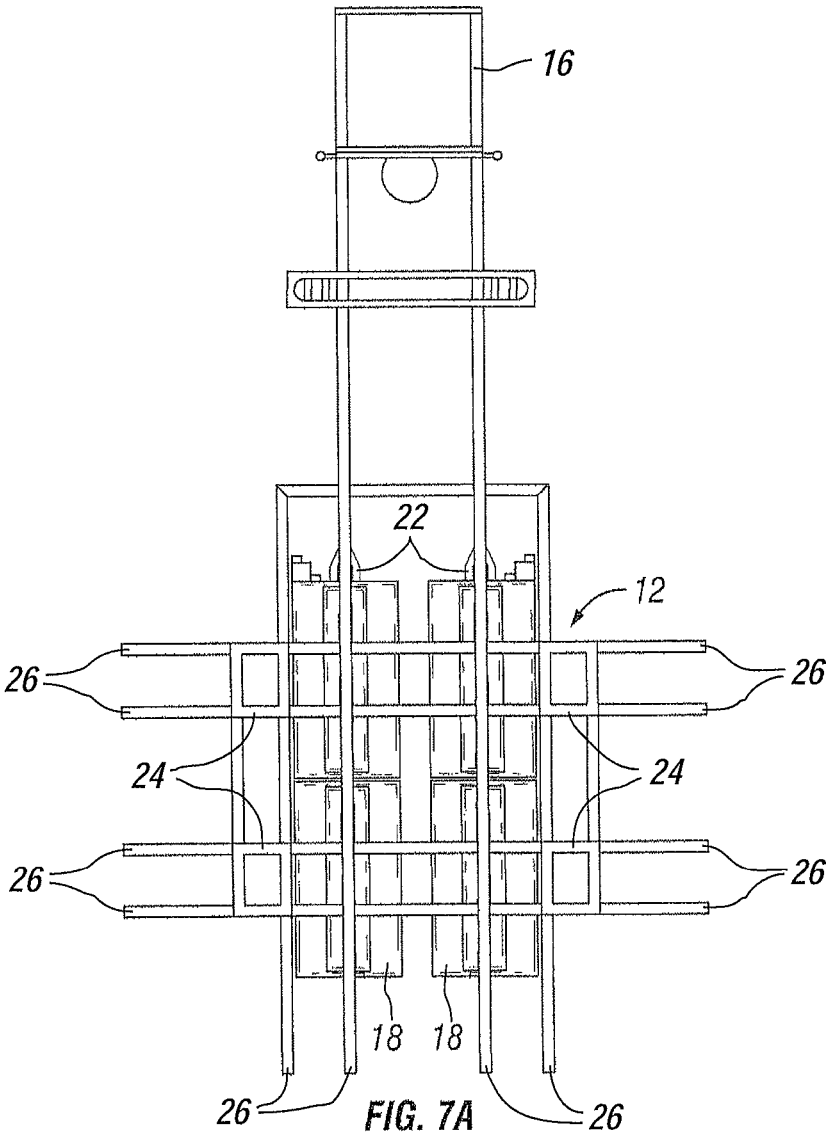
FIG. 7A is a top view of a cutaway portion of a structure similar to FIG. 1, showing wheeled frame dollies mounted inboard and supported by the rig structure itself and with retracted hingable outriggers of the present invention.
Figure 7B:
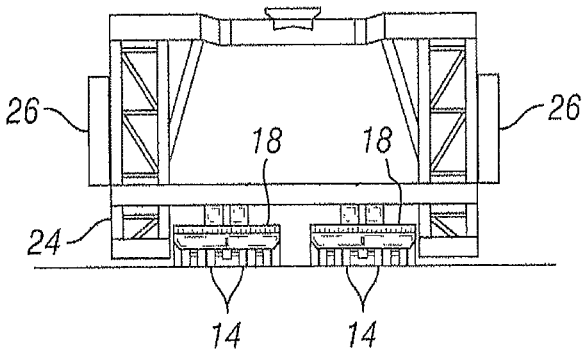
FIG. 7B is an end elevation view of the structure and retracted hinged outriggers of FIG. 7A.

In both ways of moving the rig 12 described above, there is a further option of placing the wheeled dollies 18 either under the drill rig 12 as shown in FIGS. 7A and 7B, or by placing the wheeled dollies 18 on either side of the outside portion of the drill 12 rig, as shown for example in FIGS. 4-6. In this case a pair of hinged outriggers 26 may be lowered and locked in place to transfer the weight of the rig to the wheeled frame dollies 18.

Figure 8A:
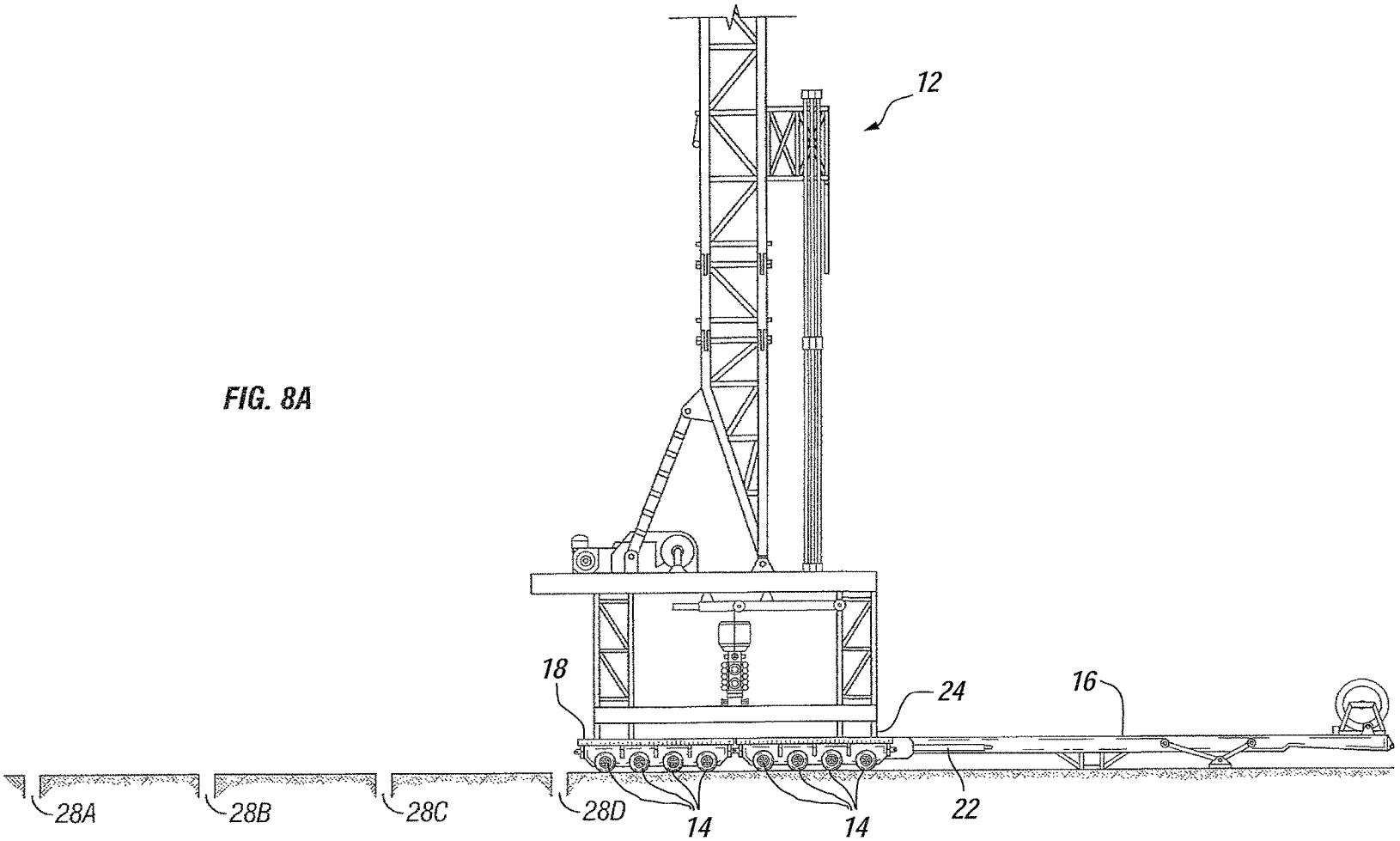
FIG. 8A is a side elevation view of a drill rig drilling a new borehole along a line of already drilled boreholes.
Figure 8B:
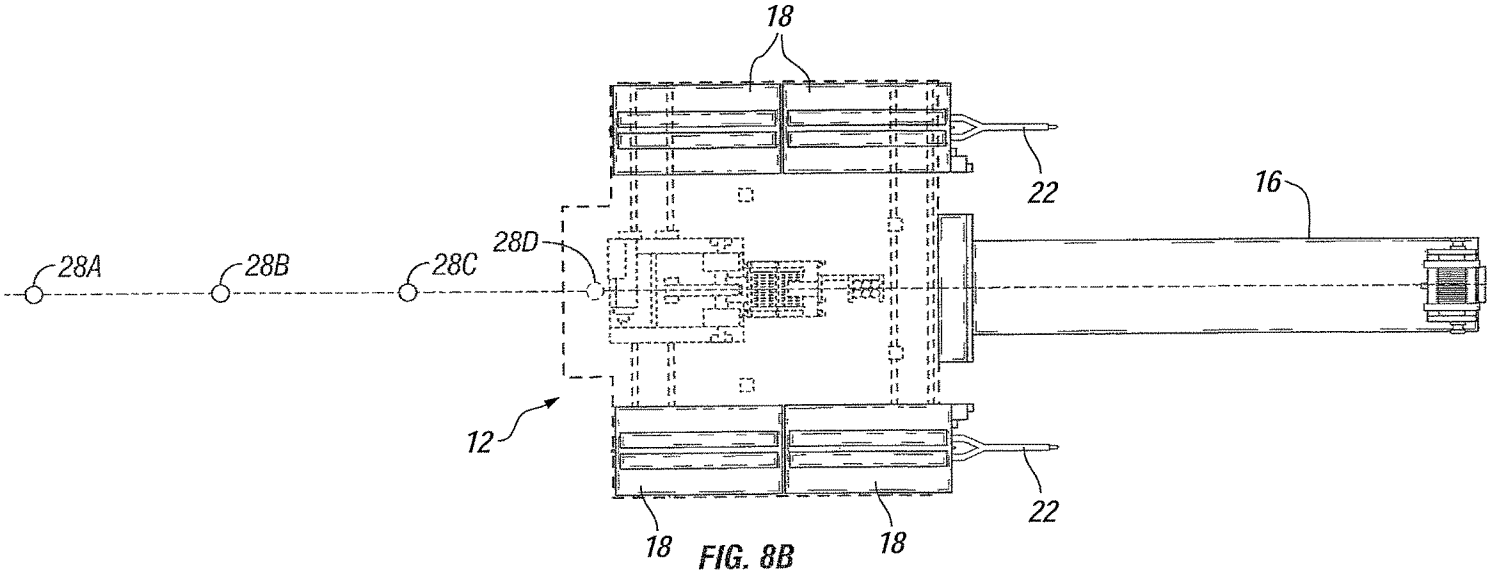
FIG. 8B is a top view of a cutaway portion of a structure similar to FIG. 8A.
Figure 10:
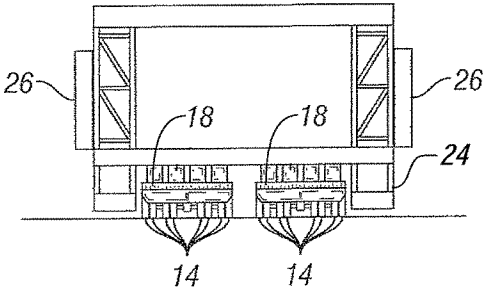
FIG. 10 is an end elevation view of a portion of a drill rig showing the retractable hinged outriggers in the retracted position.
Figure 9:
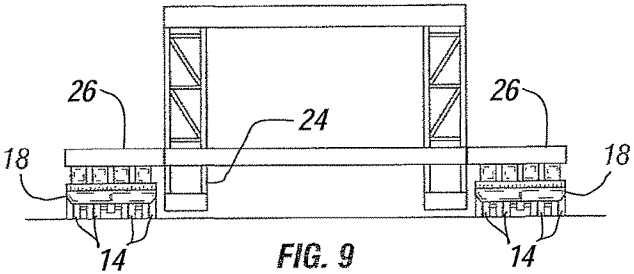
FIG. 9 is an end elevation view of a portion of a drill rig with the retractable hinged outriggers of the present invention carrying the load of the drill rig and transferring it to the wheeled frame dollies.

As oil fields become more depleted, it often requires many more boreholes to produce commercial amounts of oil. Also, some types of formations do not have good fluid communications. In both of these cases, it is often desirable to drill numerous boreholes in a grid pattern. FIG. 8B illustrates one such configuration for a line of boreholes 28A, 28B, 28C and 28D.

When this needs to be done, the task of moving the drill rig 12 becomes even more challenging, as it is now required to move both fore and aft, as well as left and right, as it moves from one line to the next. In the prior art drill rigs, the rig had to be rotated 90 degrees to make this turn, as the wellbore of the previously drilled wells may restrict the movement of the rigs—as shown for example in FIGS. 8A and 8B, which are side, and plan views of the drill rig 12 of the present invention drilling another in a series of boreholes 28A, 28B, 28C, 28D.

Again, because the drill rig 12 of the present invention has the capability of moving both laterally with the wheeled frame dollies 18, and longitudinally by utilizing the hinged outriggers 26 with the wheeled frame dollies 18, this formerly daunting task of a combination of lateral and longitudinal movement may be accomplished in far less time with far less risk of damaging the drill rig 12 or the other equipment at the site, as compared with present practice. Furthermore, the hinged outriggers 26 of the present invention may include the use of conventional hydraulic, pneumatic, servo type mechanisms, which could provide for automatic extension/retraction, and allow for electronic coordination of movement. This may be combined with other systems, and allow electronic synchronization with other rig equipment for very complex moving tasks, where multiple devices may be optionally controlled with computerized control systems.

A further advantage of the hinged outriggers is that when the rig 12 is partially dismantled for transport (as shown in FIG. 3) the load may be narrower because when stowed, the outriggers may no longer protrude beyond the frame structure of the rig.

Whereas the present invention has been described in particular relation to the drawings attached hereto, it should be understood that other and further modifications apart from those shown or suggested herein, may be made within the scope and spirit of the present invention.

What is claimed is:

1. A method, comprising:

coupling a plurality of outriggers to a drill rig structure, wherein coupling said plurality of outriggers to said drill rig structure comprises pivotably attaching each of said plurality of outriggers to said drill rig structure;

supporting a weight of said drill rig structure with said plurality of outriggers; and moving said drill rig structure while supporting said weight with said plurality of outriggers.

2. The method of claim 1, wherein supporting said weight of said drill rig structure comprises lowering each of said plurality of outriggers to a substantially horizontal extended position.

3. The method of claim 2, wherein supporting said weight of said drill rig structure comprises transferring said weight with said plurality of outriggers in said substantially horizontal extended position to a plurality of mobile support apparatuses, and wherein moving said drill rig structure comprises using said plurality of mobile support apparatuses to move said drill rig structure.

4. The method of claim 2, further comprising, after moving said drill rig structure, raising each of said plurality of outriggers to a substantially vertical retracted position and transporting said drill rig structure over a roadway from a first oilfield drilling location to a second oilfield drilling location while said plurality of outriggers are in said substantially vertical retracted position.

5. The method of claim 1, wherein moving said drill rig structure while supporting said weight with said plurality of outriggers comprises moving said drill rig structure between a first wellbore site of an oilfield drilling location and a second wellbore site of said oilfield drilling location.

6. The method of claim 5, wherein moving said drill rig structure between said first and second wellbore sites comprises moving said drill rig structure for a distance of at least approximately 100 feet.

7. The method of claim 5, wherein said first wellbore site is laterally adjacent to said second wellbore site, the method further comprising moving said drill rig structure between said second wellbore site and a third wellbore site of said oilfield drilling location, wherein said third wellbore site is longitudinally adjacent to said second wellbore site.

8. The method of claim 1, wherein said drill rig structure is a fully assembled drilling rig, and wherein a drilling mast of said fully assembled drilling rig is in a raised position while supporting said weight with said plurality of outriggers and while moving said fully assembled drilling rig.

9. A method, comprising:

pivotably coupling at least one outrigger to a drill rig structure;

pivotably rotating said at least one outrigger to a substantially horizontal extended support position;

supporting at least a portion of a weight of said drill rig structure with said at least one outrigger while said at least one outrigger is in said substantially horizontal extended support position; and moving said drill rig structure while said at least one outrigger is in said substantially horizontal extended support position and is supporting said at least said portion of said weight of said drill rig structure.

10. The method of claim 9, wherein supporting said at least said portion of said weight of said drill rig structure comprises transferring said at least said portion of said weight to at least a first rig support apparatus with said at least one outrigger.

11. The method of claim 10, wherein moving said drill rig structure comprises using said at least said first mobile rig support apparatus to move said drill rig structure.

12. The method of claim 10, further comprising positioning at least a second mobile rig support apparatus below said drill rig structure and supporting a second portion of said weight of said drill rig structure with said at least said second mobile support apparatus, wherein moving said drill rig structure comprises using said at least said first and second mobile support apparatuses to move said drill rig structure.

13. The method of claim 9, further comprising, after moving said drill rig structure, pivotably rotating said at least one outrigger to a substantially vertical retracted position and transporting said drill rig structure over a roadway from a first oilfield drilling location to a second oilfield drilling location while said at least one outrigger is in said substantially vertical retracted position.

14. The method of claim 9, wherein moving said drill rig structure comprises moving said drill rig structure between a first wellbore site of an oilfield drilling location and a second wellbore site of said oilfield drilling location.

15. A method, comprising:

coupling a plurality of hinged outriggers to a drill rig structure;

transferring a weight of said drill rig structure to a plurality of wheeled rig movement apparatuses with said plurality of hinged outriggers; and moving said drill rig structure with said plurality of wheeled rig movement apparatuses from a first wellbore location of an oilfield drilling site to a second wellbore location of said oilfield drilling site that is adjacent to said first wellbore location while said weight of said drill rig structure is transferred to said plurality of wheeled rig movement apparatuses with said plurality of hinged outriggers.

16. The method of claim 15, wherein transferring said weight of said drill rig structure to said plurality of wheeled rig movement apparatuses comprises pivotably rotating each of said plurality of hinged outriggers to a substantially horizontal extended support position and positioning said plurality of wheeled rig movement apparatuses to receive said transferred weight from said plurality of hinged outriggers in said substantially horizontal extended support position.

17. The method of claim 16, further comprising, after moving said drill rig structure to said second wellbore location, pivotably rotating each of said plurality of hinged outriggers to a substantially vertical retracted position.

18. The method of claim 17, further comprising transporting said drill rig structure over a roadway from said oilfield drilling site to a second oilfield drilling site while each of said plurality of hinged outriggers is in said substantially vertical retracted position.

19. The method of claim 15, further comprising, prior to moving said drill rig structure from said first wellbore location, using said drill rig structure to perform a first drilling operation on said first wellbore location, and after moving said drill rig structure to said second wellbore location, using said drill rig structure to perform a second drilling operation on said second wellbore location.

* * * * *